United States Patent [19]

Egger

[11] 4,437,828

[45] Mar. 20, 1984

[54] SCREED BAR ASSEMBLY

[76] Inventor: David L. Egger, 1270 Lynwood St., LaHabra, Calif. 90631

[21] Appl. No.: 339,190

[22] Filed: Jan. 15, 1982

[51] Int. Cl.[3] ..... B28B 1/29; B28B 21/92; E01C 19/00; E01C 19/22

[52] U.S. Cl. ..... 425/458; 248/188.4; 248/354 S; 404/119; 404/135

[58] Field of Search ..... 425/458; 248/161, 166–168, 248/598, 595, 188.2, 188.5, 214, 219.4, 188.7, 188.8, 188, 173, 167, 188.4, 354 S, 650; 404/118, 119, 135, 136; 52/633, 365–367, 741

[56] References Cited

U.S. PATENT DOCUMENTS

| | | | |
|---|---|---|---|
| 342,153 | 5/1886 | Whitcomb | 248/166 |
| 351,990 | 11/1886 | Mansure | 248/166 |
| 1,725,168 | 8/1929 | Willis | 248/166 |
| 2,158,546 | 5/1939 | Lang et al. | 248/188.4 |
| 2,767,618 | 10/1956 | Nistri | 248/166 |
| 3,811,787 | 5/1974 | Beaty et al. | 404/118 |
| 4,115,976 | 9/1978 | Rohrer | 404/119 |
| 4,371,330 | 2/1983 | Heffernan | 425/458 |

FOREIGN PATENT DOCUMENTS

| | | | |
|---|---|---|---|
| 399509 | 3/1966 | Switzerland | 404/119 |
| 270234 | 7/1970 | U.S.S.R. | 425/458 |

*Primary Examiner*—Willard E. Hoag

*Attorney, Agent, or Firm*—Gausewitz, Carr, Rothenberg & Edwards

[57] ABSTRACT

A screed bar support saddle is carried by vertically adjustable legs mounted on the ends of support arms swingable in a horizontal plane so as to vary the spacing between the legs, between the legs and the screed bar, and to adjustably position the legs relative to the screed bar. The adjustable positioning and spacing of the legs enables the screed bar support assembly to be placed to avoid interference with reinforcing steel or wire, pipes, and the like, and to accommodate concrete pouring upon corrugated surfaces having different spacing of-corrugating grooves. The screed bar is held against torsional and pivotal motion within a support saddle and precisely adjusted in elevation by rotation of an adjustment tool formed on the end of a sight rod that is used with a transit, level, or the like, for precision elevation control.

16 Claims, 7 Drawing Figures

FIG. 1.
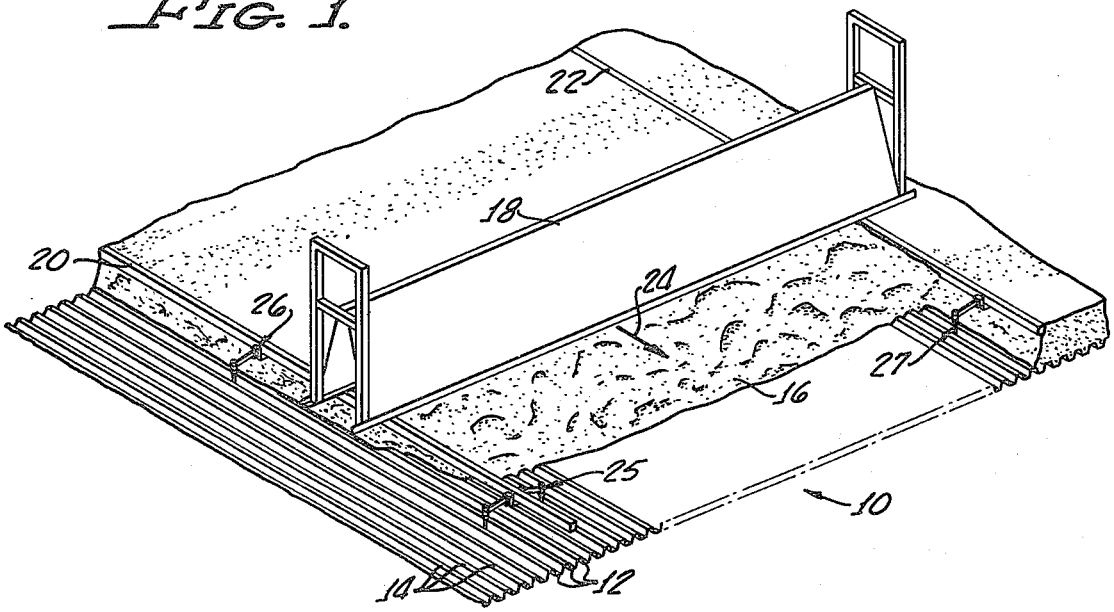
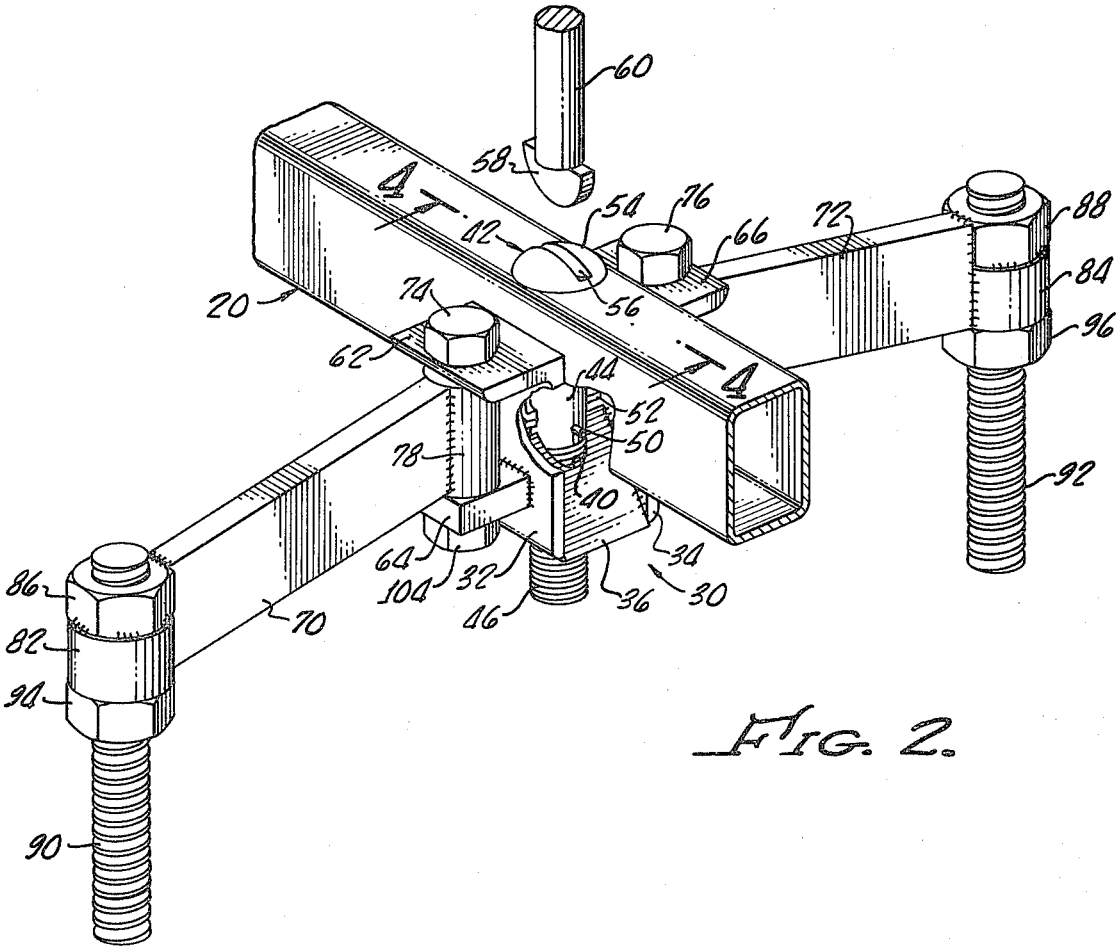
FIG. 2.

SCREED BAR ASSEMBLY

BACKGROUND OF THE INVENTION

The present invention relates to the surfacing of concrete, and more particularly, concerns methods and apparatus for supporting and controlling elevation of a concrete surfacing screed.

In the pouring of concrete having level or generally level surfaces, it is common to establish a pair of spaced, parallel screed bars or rails having upper (or lower) surfaces at a fixed elevation above the desired surface of the finished concrete. The concrete is poured between screed bars to a level slightly above the desired finished level, and thereafter a screed, resting upon the screed bars or rails, is moved over the surface of the concrete for the purpose of both vibrating the wet, uncured material and achieving a final or near final finished surface.

Each screed bar or rail is supported upon a series of screed chairs or similar supports, which are placed upon the ground or other surfaces upon which the concrete is to be poured. The screed supports provide means for achieving vertical adjustment so that the screed bar will be at the desired elevation throughout its length. At least partly because the weight of a vibrating screed may be great, the screed chairs must be strong and have good lateral stability to avoid tilting. Thus, the chairs often have a number of legs which collectively support the screed bar and yet extend laterally outward for improved support.

Where concrete is being poured upon a surface having various types of obstructions (such as columns, posts, pipes, reinforcing steel, and the like) or where the surface is a corrugated metal sheet (such as commonly employed Robinson decking), it is difficult to properly position all of the required screed chairs or supports without encountering interference between the support legs and the obstructions. The problem is enhanced by the lateral extent of the legs required for stability, so that each screed chair necessarily spans a relatively large lateral area.

In the placement of the screed support upon corrugated Robinson decking, the support legs are positioned within the grooves to hold the screed support above the ridges of the decking corrugations. The width of the ridges and grooves in Robinson decking may vary from one type of decking to another, and, therefore, screed supports may be required to be built to accommodate specific corrugation spacing. For this reason, a screed chair for decking of one corrugation width may not be readily used with decking of a different corrugation width.

Accordingly, it is an object of the present invention to provide a screed support assembly that avoids or minimizes the above-mentioned problems.

SUMMARY OF THE INVENTION

In carrying out principles of the present invention, in accordance with a presently preferred embodiment thereof, a screed bar support (or "saddle") is supported by a pair of outwardly spaced legs that are carried so as to be adjustably positioned relative to one another and to the support. The screed bar is supported in the saddle for vertical adjustment, and, according to a feature of the invention, is restrained against twisting with respect to the saddle, so as to enable the legs to support the screed bar when the legs are moved to avoid obstacles. According to another feature of the invention, the screed bar vertical adjustment member is accessible from above, so that a sight pole having an adjustment tool at its lower end may be vertically positioned in engagement with the adjustment member for rapid elevation adjustment and elevation readout.

BRIEF DESCRIPTION OF THE DRAWINGS

FIG. 1 is a pictorial illustration of the use of screed support assemblies embodying principles of the present invention, as applied to the screeding of concrete poured upon a corrugated surface;

FIG. 2 is a pictorial illustration, with parts broken away, of a screed support and a section of a screed bar, showing part of an elevation adjusting tool displaced from the screed bar;

DETAILED DESCRIPTION OF THE PREFERRED EMBODIMENT

Figure 4:
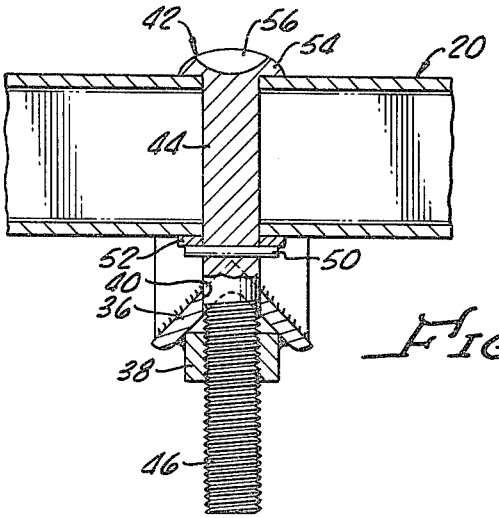
FIG. 4 is a vertical section of the apparatus of FIG. 2 showing the tool in adjusting position.

Although the screed bar assembly of the present invention is capable of use on many types of horizontal or generally horizontal surfaces upon which concrete is to be poured, it is of significant advantage in the pouring of concrete on a corrugated surface known as Robinson decking, and it is in such an application that the invention will be initially described.

Illustrated in FIG. 1 is the pouring of concrete upon a corrugated surface 10 of Robinson decking which comprises a corrugated metal sheet having a number of parallel corrugations forming mutually spaced, parallel grooves 12 separated by mutually spaced, parallel ridges 14. The corrugated decking is supported by conventional means (not shown) and is frequently employed as part of a floor of a multi-story building.

Wet, uncured concrete 16, poured upon the surface of the decking, is smoothed and surfaced by means of a vibratory screed, schematically shown at 18, which may be any one of many types of such devices (either motorized or manual) well known to those skilled in this art. The screed 18 is supported upon mutually spaced, parallel screed bars or screed rails 20, 22 and moved along the rails in the direction of arrow 24 to vibrate and surface the poured concrete.

Because the surface of the concrete becomes the finished surface of the building floor, and, further, because the screed rails 20, 22 determine the elevation of the screed 18, and thus the elevation of points on the finished floor, it is essential that the elevation of the rails be carefully established and maintained. To this end, the screed rails or bars are each supported by a number of screed chairs, supports or support assemblies, such as those shown in FIG. 1 at 25, 26 and 27. The support assemblies 25, 26 and 27 are mutually spaced along the length of each screed bar and incorporate legs that rest upon the surface, preferably within the grooves 12. After screeding has been completed, the screed, the screed rails, and all of the screed rail supporting chairs are removed. Holes resulting from the removal of the screed bar support assemblies are readily patched.

Details of a typical screed support assembly are shown in FIGS. 2 through 5. Each screed support assembly comprises a substantially U-shaped support or saddle 30 having mutually spaced, parallel, upstanding sidewalls 32, 34 rigidly interconnected at their lower end by a wedge-shaped base 36 having an upwardly facing apex and outwardly and downwardly sloping sides that help to prevent the buildup of concrete within the saddle. An internally threaded member, such as nut 38, is welded to the base in alignment with an aperture 40 in the base apex that receives an adjusting bolt 42. Bolt 42 has a smooth, unthreaded shank 44 that extends through aligned holes in upper and lower surfaces of the screed bar 20 which, in the exemplary arrangement described herein, is a steel tube of substantially square cross section. The lower end of adjusting bolt 42 is threaded, as at 46, and extends through the aperture 40 of the base 36 in threaded engagement with nut 38. A screed bar support pin 50 extends through, and projects outwardly on both sides of the bolt 42 below the screed bar to support the latter by means of an interposed washer 52. Bolt 42 has an enlarged head 54 in which is formed a tool receiving slot 36 that receives a mating adjusting tool 58 formed on the lower end of a sighting pole 60.

Each saddle sidewall 32, 34 is formed with a pair of vertically spaced, laterally outwardly projecting flanges 62, 64, 66, 68. Swing arms 70, 72 are pivotally connected to opposite sides of saddle 30 on vertical pivot bolts 74, 76, which extend through the sidewall flanges and through vertically elongated pivot sleeves 78, 80, respectively, fixed at inner ends of the swing arms.

Outer ends of the swing arms fixedly carry supporting leg receiving sleeves 82, 84 to which are fixed nuts 86, 88 that threadedly receive respective ones of threaded outer adjustment legs 90, 92. Lock nuts 94, 96 are also threaded upon the legs for maintaining the legs in adjusted position.

Swing arms 70, 72 are inclined downwardly and outwardly from the saddle to avoid interference between the upper ends of legs 90, 92 and the screed. Tool receiving head 54 of vertical adjustment bolt 42 is rounded to facilitate the passage of the screed over the bolt head as the screed travels along the rail. If deemed necessary or desirable, the head of adjusting bolt 42 may be recessed to avoid protrusion above the upper surface of the rail upon which the screed rides. Importantly, however, the tool receiving head of the adjusting bolt is readily accessible from above the screed bar by means of the tool 58 which is carried at the end of the vertically positioned sight bar 60. The sight bar carries a target sleeve 100 (FIG. 4) that is vertically adjustable and locked in position by means of a rod 102 threaded in an aperture of the sleeve and extending therethrough to press against the shaft of pole 60.

Coarse adjustment of the height of the screed bar (at about one inch below final elevation, for example) is achieved by adjustment of outer legs 90, 92, which are thereafter locked in such vertically adjusted position by means of lock nuts 94, 96. Fine adjustment of the screed bar is made by placing the tool 58 in the tool slot 56, the latter being concave upwardly to restrain the tool from sliding out of the slot. The vertically positioned sight pole is rotated to provide fine vertical adjustment of the screed bar elevation. Without moving the adjusting tool from its operating connection with the adjusting bolt 42, the sight pole target 100 may be sighted by a conventional instrument, such as a transit, level or laser leveling device. In fact, the target 100, which is a continuous cylinder, may be continuously viewed while the adjustment is actually being carried out by rotating the sight pole, thereby to greatly expedite and enhance the speed and accuracy of the elevation adjustment.

Figure 5:
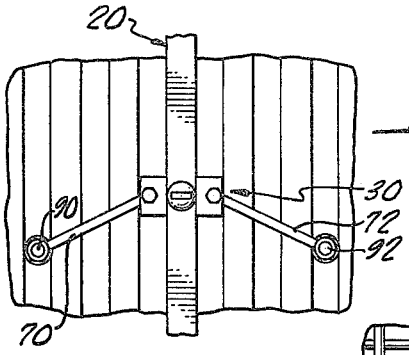
FIG. 5 is a fragmentary plan view of a screed bar assembly.
Figure 3:
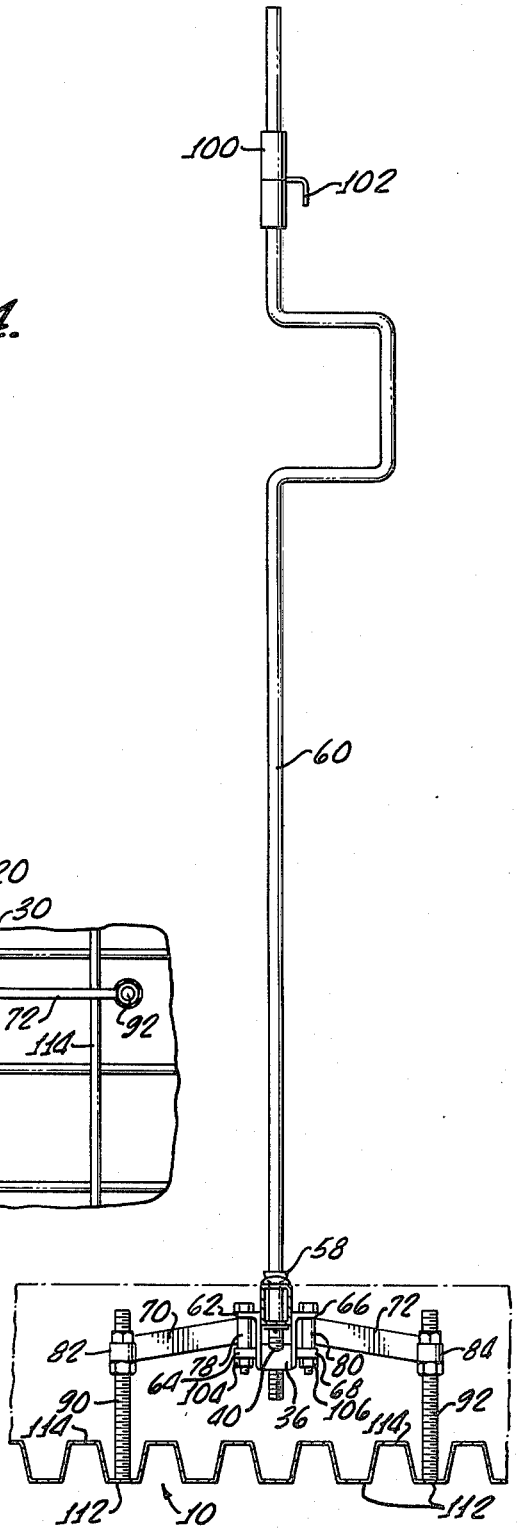
FIG. 3 is a fragmentary, longitudinal section taken along the screed bar of FIG. 2.

As can be most readily understood from inspection of FIGS. 3 and 5, the position of the legs 90, 92 relative to the screed support saddle 30 is adjustable so that the legs may be moved to and from the screed bar itself. Moreover, the spacing between the legs may be varied. Adjustable positioning of the legs is accomplished by means of swing arms 70, 72. The swing arms are pivoted about their pivot bolts 74, 76 to thereby enable each leg to swing in a horizontal plane toward and away from the screed bar until the leg is seated within the groove 12 of the corrugated surface 10, instead of upon a ridge 14. Obviously, if the legs are spaced so that one or both must rest upon a ridge of the corrugated surface, it will be difficult, if not impossible, to properly position the screed bar in elevation. The illustrated screed bar assemblies are useful with corrugated decking of various widths of ridges and grooves and may be readily adjusted merely by pivoting the swing arms. Once the pivotal adjustment of the swing arms has been accomplished, lock nuts 104, 106 on the lower ends of the pivot bolts can be tightened to lock the pivot sleeves 78, 80 between the flanges 62, 64 and 66, 68 of the saddle sides.

Figure 6:
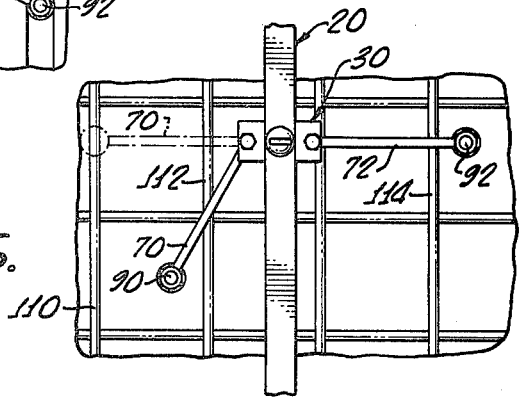
FIG. 6 illustrates the use of the screed bar assembly positioned to avoid reinforcing steel.

The variable positioning of the outer legs 90, 92 not only enhances use of the screed bar support assembly on corrugated decking, but also enables positioning of the legs to avoid other obstacles, such as pipes, columns or reinforcing wire. For example (as illustrated in FIG. 6), a concrete reinforcement, including steel bars or wires 110, 112 and 114, may be supported above the surface that is to form the lower side of the poured concrete slab and may be located at various positions adjacent the screed bar 20. Reinforcing element 114 may be sufficiently close to the saddle 30 as to enable the swing arm 72 to freely pass above the reinforcing element. Reinforcing 110, on the other hand, may, in this exemplary arrangement, either interfere with a direct lateral positioning of the swing arm 10 and its leg (shown in dotted lines in FIG. 6) by directly interfering with a leg, or may be so close to the leg, at which point the inclined swing arm 70 is relatively low, that the arm will rest upon the reinforcing element 110 to thereby prevent the leg from resting upon the surface. However, with the described adjustable positioning of the legs, swing arm 70 is merely pivoted to move it closer to the screed bar 20 and to enable both the leg and arm 70 to clear the reinforcing elements.

It may be noted that each swing arm has freedom of motion of slightly more than 180°, and each may assume a position in which the arm is substantially parallel and closely adjacent to the screed bar itself. In such a condition (a condition such as that illustrated in solid lines in FIG. 6, or in an arrangement in which swing arm 70 is even more closely parallel to screed bar 20), the weight of the screed bar upon the saddle is offset from a line joining the legs. This tends to tilt the legs, greatly diminishing their ability to carry the screed bar. However, the screed bar is secured to and within the saddle by an arrangement that prevents turning or twisting of the screed bar relative to the saddle. This torsional restraint, in turn, helps to restrain tilting of the support legs 90, 92. Resistance to torsion while allowing vertical adjustment is accomplished by the saddle and its adjusting mechanism.

As can be seen in FIGS. 3 and 4, adjusting bolt 42 bears against the screed bar at vertically spaced points, one on the upper wall of the bar and the other on the lower wall of the bar. Similarly, bolt 42 bears upon the saddle at vertically spaced points, one near the upper portion of the wedge-shaped base 36 and the other at the nut 38. Accordingly, relative torsional or twisting movement of the screed bar with respect to the saddle is restrained. Torsional or twisting motion of the screed bar about an axis extending along its length is further restrained by engagement of the screed bar with adjacent screed bar chairs. Because the screed bar is, in effect, torsionally fixed to the saddle, the latter cannot tilt without twisting the screed bar, and, thus, tilting of the chair is restrained.

Accordingly, the described screed bar support assemblies will support the screed bar even with the outer legs in extreme positions of adjustment. Further, such support is provided with the use of only two legs that merely rest upon, and are not otherwise secured to, a supporting surface. With the described arrangement, there is no need to provide more than two legs, nor is there any need to fixedly connect any leg to its supporting surface.

The anti-torsional, but vertically adjustable connection of the screed bar to the saddle significantly stabilizes the legs, when the swing arms 70, 72 extend in mutual alignment at right angles to the screed bar. Further, the screed bar may be moved in the direction of its length, moving all of the connected support structures with it, without tilting the two-legged screed bar supports because of the anti-torsional screed bar mounting.

Figure 7:
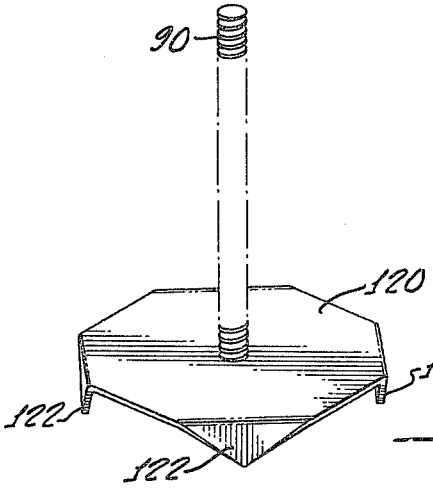
FIG. 7 illustrates an alternate arrangement of the supporting legs.

Although the apparatus described above is uniquely adapted for improved operation upon corrugated surfaces, it also may be employed upon soil surfaces, in which case, in order to enlarge the leg supporting area and prevent the legs from sinking into the ground, each outer leg 90, 92 may have fixed to its lower end a flat plate 120 (FIG. 7) which may have its corners turned down at 90°, as at 122, to prevent lateral sliding of the plate upon the earth or other soft surface.

It will be observed that the swing arm pivot structures, including bolts 74, 76, are below the upper surface of the screed bar 20, even when the latter is in a lower position, so as to avoid interference with a screed riding upon the upper surface of the screed bar. Further, the downward and outward slope of the swing arms 70, 72 provides a wider range of coarse vertical adjustment via the legs 90, 92, so that even when these legs are adjusted to a lower position of the saddle, the upper portions of the legs will not extend above the screed surface. Of course, legs of varying lengths may be provided for different applications, as deemed necessary or desirable.

Although the described adjustments—the coarse vertical adjustment of the legs, the positioning of the swing arms and legs, and the vertical adjustment of the screed bar—may be achieved by other mechanical arrangements, such as sliding or telescopic motions, the described configurations are preferred because they are most reliable and least subject to damage and jamming in the very difficult environment of wet concrete. All threaded elements have coarse threads of the type commonly used in devices that are adapted to be contacted by wet concrete mixes, although a finer thread may be used for the fine adjustment bolt 42.

In setting up the described screeding arrangements, the legs 90, 92 are adjustably positioned, as desired, with respect to the saddle and vertically adjusted. The screed bar, having a number of bolts 42 extending therethrough and secured to it by means of pins and washers 50, 52, is then positioned over a plurality of support saddles, and the several adjusting bolts 42, which are captured in the screed bar, are individually inserted through the apertures of saddle bases 36 and then are threaded into the saddle base nuts. When the legs 90, 92 have been approximately positioned to support the screed bar at the appropriate elevation, sight pole 60 with its adjusting tool 58 is inserted in the bolt head, and the pole is turned until the sighting instrument determines that sight pole target 100 is at the desired elevation for that part of the screed bar.

Where an obstacle interferes with placement of one of the screed bar support saddle legs, the leg is simply moved to an adjusted position clear of the obstacle. There is no need to re-position the screed bar. Once the screed bar has been connected to, and mounted within, a series of support saddles, the entire arrangement of the bar and the several support saddles connected thereto may be bodily shifted as a unit. However, upon completion of a screeding operation, it may be preferable to first remove the screed bar from all of the saddles before removing the saddles and their support swing arms and legs from the concrete in which they have become embedded.

The foregoing detailed description is to be clearly understood as given by way of illustration and example only, the spirit and scope of this invention being limited solely by the appended claims.

What is claimed is:

1. A screed support assembly comprising a screed bar support, a screed bar mounted in said support for vertical adjustment, first and second support legs positioned outwardly of said support, and means for mounting at least one of said legs to said support for motion relative to said screed bar, whereby the position of said one leg relative to the other of said legs and relative to the screed bar may be adjusted.

2. The assembly of claim 1 wherein said means for mounting comprise first and second arms pivotally connected to said support at opposite sides thereof for motion about substantially vertical axes, said legs being respectively connected to outer ends of said arms.

3. The assembly of claim 1 including means for resisting relative twisting of said screed bar and support.

4. The screed bar assembly of claim 1 wherein said means for mounting said one leg to said support comprise a swing arm connected to said one leg and pivotally connected to said support.

5. The assembly of claim 4 wherein said one leg is movably carried by said arm for adjustment to thereby provide for further vertical adjustment of said screed bar.

6. The assembly of claim 1 wherein said support comprises a substantially U-shaped saddle having first and second upstanding sides interconnected by a base, an internally threaded member fixed to said base, a threaded rod extending through said base and threadedly engaged with said threaded member, and means for supporting said screed bar upon said threaded rod.

7. The assembly of claim 6 wherein said threaded rod extends through said screed bar and carries a screed bar support element in contact with a lower surface of the screed bar.

8. The assembly of claim 6 wherein said first and second saddle sides and said screed bar have mutually interfitting configurations that restrain twisting of said screed bar within said saddle about the axis of the screed bar.

9. The assembly of claim 6 wherein said threaded rod engages said screed bar at vertically spaced points and engages said base at vertically spaced points to thereby restrain turning of said screed bar in said saddle.

10. An adjustable screed support assembly comprising a support, a screed bar adjustably carried by said support, first and second support legs positioned laterally outwardly of said support, first and second swing arms connected to said support for pivotal motion about substantially vertical axes, and means for connecting said legs to said arms, whereby each leg may be adjustably positioned relative to the support by swinging one of said arms about its pivotal axis.

11. The assembly of claim 10 including means for restraining twisting of said screed bar relative to said support whereby said screed bar may resist tilting of said legs.

12. The assembly of claim 11 wherein said means for restraining twisting comprise a bolt extending through said screed bar and through at least a part of said support, said bolt contacting said screed bar at vertically spaced points and contacting said support part at vertically spaced points.

13. A screed support assembly comprising a screed bar support saddle having first and second mutually spaced, substantially parallel, upstanding sidewalls and a base extending between and interconnecting lower ends of the sidewalls, an internally threaded member fixed to said base, a screed bar in said support saddle, a threaded rod extending through said screed bar and threadedly engaged with said threaded member, means on said threaded rod for supporting said screed bar, and means for holding said support saddle above a surface.

14. The assembly of claim 13 wherein said threaded member includes a tool receiving head accessible from above said screed bar whereby screed bar elevation can be adjusted from above.

15. The assembly of claim 13 wherein said saddle base is substantially wedge-shaped, having outwardly and downwardly sloping sides.

16. The assembly of claim 13 wherein said means for holding said support saddle comprise a first swing arm pivoted to said first sidewall at an inner end of the arm, a first leg adjustably connected to an outer end of said first arm, a second swing arm pivotally connected to said second sidewall at an inner end of the arm, and a second leg adjustably connected to an outer end of said second arm.

* * * * *